US005887705A

United States Patent [19]

Renevey

[11] Patent Number: 5,887,705

[45] Date of Patent: Mar. 30, 1999

[54] PACKAGING AND PRESENTATION DEVICE FOR AT LEAST ONE PIECE OF JEWELRY OR A TIMEPIECE AND PRESENTATION OR STORING SUPPORT FOR AT LEAST ONE PIECE OF JEWELRY OR A TIMEPIECE, SAID SUPPORT BEING CAPABLE OF BEING USED IN THE DEVICE

[75] Inventor: Roland Renevey, Rosé, Switzerland

[73] Assignee: Gainerie Moderne, Fribourg, Switzerland

[21] Appl. No.: 951,588

[22] Filed: Oct. 16, 1997

[30] Foreign Application Priority Data

Oct. 17, 1996 [CH] Switzerland ..... 1996 2541/96

[51] Int. Cl.[6] ..... A45C 11/04

[52] U.S. Cl. ..... 206/6.1; 211/55.2; 206/566

[58] Field of Search ..... 206/6.1, 301, 566; 211/55.2

[56] References Cited

U.S. PATENT DOCUMENTS

| | | | |
|---|---|---|---|
| 1,770,534 | 7/1930 | Shields | 206/301 |
| 1,774,430 | 8/1930 | Flier . | |
| 1,909,020 | 5/1933 | Shields | 206/301 |
| 1,980,776 | 11/1934 | Warner | 206/301 |
| 2,180,885 | 11/1939 | Sundee . | |
| 4,011,942 | 3/1977 | Crosslen . | |
| 4,082,183 | 4/1978 | Sturm | 206/301 |
| 4,216,858 | 8/1980 | Beauchamp | 206/301 |
| 4,830,181 | 5/1989 | Hartman | 206/301 |
| 5,181,608 | 1/1993 | Herzog . | |
| 5,383,552 | 1/1995 | Dikowtz . | |

FOREIGN PATENT DOCUMENTS

| | | |
|---|---|---|
| 518 081 | 3/1972 | Switzerland . |
| 581 459 | 11/1976 | Switzerland . |

*Primary Examiner*—Paul T. Sewell
*Assistant Examiner*—Nhan T. Lam
*Attorney, Agent, or Firm*—Foley & Lardner

[57] ABSTRACT

In a packaging and presentation device for a piece of jewelry or a timepiece, which comprises a support intended to receive said piece, according to a first configuration, the support is formed of a first module having a supporting surface of a first supporting length or, according to a second configuration, it results from the assembly of the first module with at least a second, complementary and removable module, the support according to this second configuration having a supporting surface of a second supporting length which is greater than the first one. Thus, the device, which is easy to manufacture and economical, allows an advantageous packaging and presentation of several types of pieces of jewelry or watches. The support and its multiple configurations in function of the number and the dimensions of the used modules allows the use of a single device for pieces of jewelry or watches of different sizes. The removable module of the support facilitates its adaptation to the size of the packaged and/or presented piece.

12 Claims, 2 Drawing Sheets

PACKAGING AND PRESENTATION DEVICE FOR AT LEAST ONE PIECE OF JEWELRY OR A TIMEPIECE AND PRESENTATION OR STORING SUPPORT FOR AT LEAST ONE PIECE OF JEWELRY OR A TIMEPIECE, SAID SUPPORT BEING CAPABLE OF BEING USED IN THE DEVICE

BACKGROUND OF THE INVENTION

The present invention refers to a packaging and presentation device for at least one piece of jewelry or a timepiece, said device comprising a support which is intended to receive said piece. The invention also refers to a presentation or storing support for at least one piece of jewelry or a timepiece, said support being capable of being used in such a device.

The packaging and presentation devices for jewelry or watches (also called presentation-cases) which are widely sold today are composed of rigid structures from synthetic materials or from cardboard which are generally in the form of a box comprising a receptacle portion in which the watch or the piece of jewelry is intended to be positioned directly or by means of a support while a cover is intended to be lowered onto said portion in order to close the box. To this end, this type of box generally comprises a mechanical closure system. In the case of a bracelet or of a wrist watch, the bracelet is closed in order to be maintained on the support. In order to allow an advantageous presentation of pieces of different sizes, different supports are provided which are specifically suited to hold particular pieces, such as wristwatches for men, for ladies or for children, each having its own standard bracelet length.

The object of the invention is to provide a packaging and presentation device for at least one piece of jewelry or a timepiece with a support for said piece which allows an advantageous packaging and presentation of several types of pieces of jewelry or watches and whose manufacture is simple and economical.

SUMMARY OF THE INVENTION

This object is attained by a packaging and presentation device wherein according to a first configuration, said support is formed of a first module having a supporting surface of a first supporting length or, according to a second configuration, results from the assembly of said first module with at least a second, complementary and removable module, the support according to this second configuration having a supporting surface of a second supporting length. The support, which may have several configurations according to the number and the dimensions of the used modules, allows the use of a single device for pieces of jewelry or watches of different sizes without the need of providing entire supports of different, specifically adapted sizes, thus allowing a substantial reduction of the production costs. The removable module(s) of the support facilitate(s) the adaptation of the latter to the size of the packaged and/or presented piece.

The means defined in the dependent claims in turn allow to realize the invention according to preferred embodiments.

BRIEF DESCRIPTION OF THE DRAWINGS

An embodiment of the device of the invention will now be described as a non-limiting example with reference to the accompanying drawings, wherein.

DETAILED DESCRIPTION OF THE INVENTION

Figure 1A:
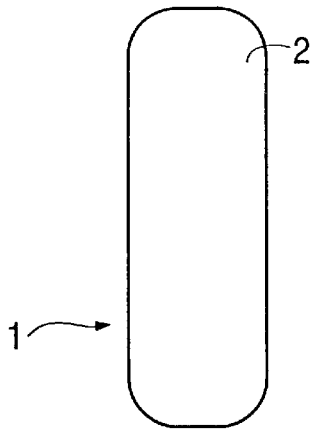
FIG. 1*a*–1*c* shows three orthogonal views of the first module of the invention.
Figure 1B:
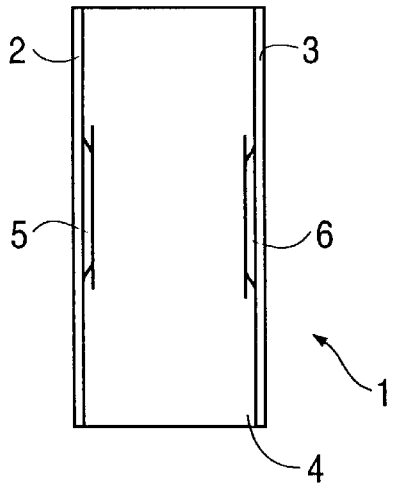
Figure 1C:
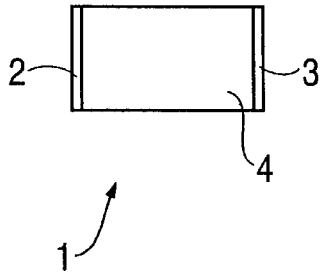

Figs. 1*a*, 1*b*, and 1*c* represent three orthogonal views of the first module 1 according to the invention, Figs. 1*a* and 1*c* showing a first and a second side elevation of module 1, respectively, and Fig. 1*b* showing a plan view. Module 1 is substantially cylindrical in shape while its cross-section is oval or oblong. The two parallel sides 2, 3 of module 1 are e.g. made of cardboard, of wood, or of a synthetic material, their external surfaces being preferably covered with leather, suede, imitation leather, cloth, or any other suitable material. Between said sides 2, 3, a portion serving as a cushion, e.g of foam, is provided which is surrounded by a continuous cylindrical supporting surface 4 of leather, suede, imitation leather or any other suitable material, said supporting surface 4 being intended to receive one or several pieces of jewelry or watches. The supporting length of said supporting surface 4 approximately corresponds to the length of the circumference of sides 2, 3.

First module 1 is provided with two parallel lateral slots 5, 6 which are adapted to receive two corresponding lateral tongues of the second module (see FIG. 2). Said slots 5, 6 are advantageously provided near sides 2, 3 and about halfway from the ends of oblong module 1 (see Fig. 1*b*). They represent means allowing to removably connect the first and the second module.

Figure 2A:
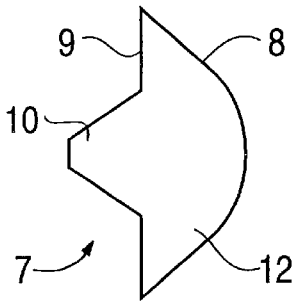
FIG. 2*a*–2*c* shows three orthogonal views of the second module of the invention.
Figure 2B:
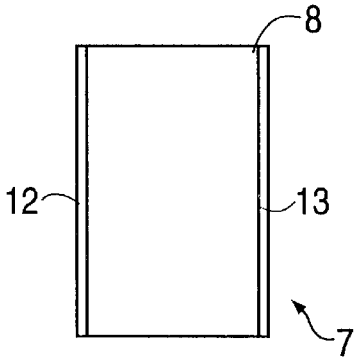
Figure 2C:
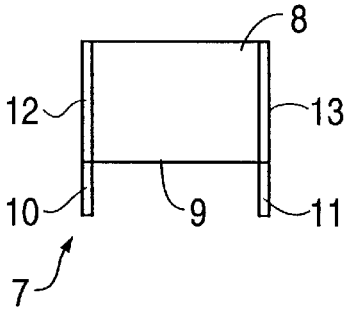

FIGS. 2*a*, 2*b*, and 2*c* represent three orthogonal views of second module 7 according to the invention, FIGS. 2*a* and 2*c* showing a first and a second side elevation of module 7, respectively, and FIG. 2*b* showing a plan view. Module 7 has a discontinuous :supporting surface 8 which is followed on either side ba a junction, i.e. a portion which joins said supporting surface 8, the latter comprising a surface 9 which is intended to face or contact a portion of the supporting surface of first module 1.

Furthermore, second module 7 is provided with two lateral tongues 10, 11 which are destined to cooperate with lateral slots 5, 6 of first module 1. Said tongues 10, 11 are preferably shaped as partial prolongations of the two paralles sides 12, 13 which are e.g. made of cardboard, of wood, or of a synthetic material while their external surfaces are covered with leather, suede, imitation leather, or any other suitable material. Tongues 10, 11 have a triangular or trapezoid shape whereby the attachment and the removal of the support is facilitated. Between said sides 12, 13 is provided a portion which serves as a cushion, e.g. of foam, which is surrounded, on one hand, by the discontinuous cylindrical supporting surface 8 of leather, suede, imitation leather, or any other suitable material and, on the other hand, by junction surface 9.

Figure 3:
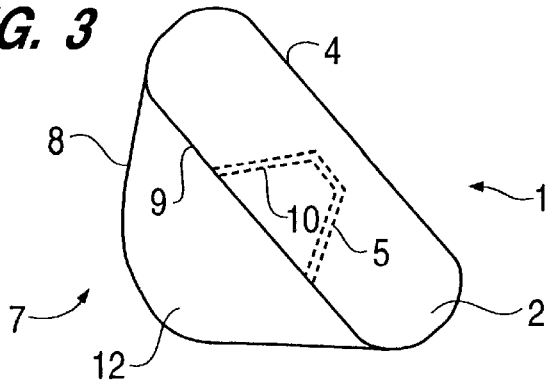
FIG. 3 is a schematical, partly sectioned side elevation of the first and the second module in the assembled state.

FIG. 3 is a partly sectioned, schematical side elevation of the first and the second module 1, 7 in the assembled state. Tongues 10, 11 are inserted in the respective slots 5, 6, thus removably connecting, by virtue of friction, the first and the second module 1, 7 which together have an essentially cylindrical shape with an approximately triangular cross-section whose corners are rounded. In this second configuration, the support has a supporting surface 4, 8 whose supporting length is greater than the "length" of supporting surface 4 of the sole first module 1, the support thus being adaptable, according to the dimensions of second module 7, to the most different sizes of pieces of jewelry or of watches to be packaged and/or presented. It is also possible to provide e.g. a third module which might be attached to the first module 1 or to the second module 7, thus allowing to realize a support whose supporting surface has yet another length.

In the illustrated example, first module 1 may by itself represent a support whose supporting surface 4 is capable of receiving e.g. a wrist watch for ladies. However, when provided with detachable second module 7, this first module 1 forms a new support whose prolongated supporting surface 4, 8 is capable of receiving e.g. a wrist watch for men.

Although slots 5, 6 and tongues 10, 11 have been found to be advantageous with respect to the production costs and an easy assembly and detachment of the support as well as a safe and reliable connection of modules 1 and 7, it is understood that any other suitable connecting means is possible.

Figure 4A:
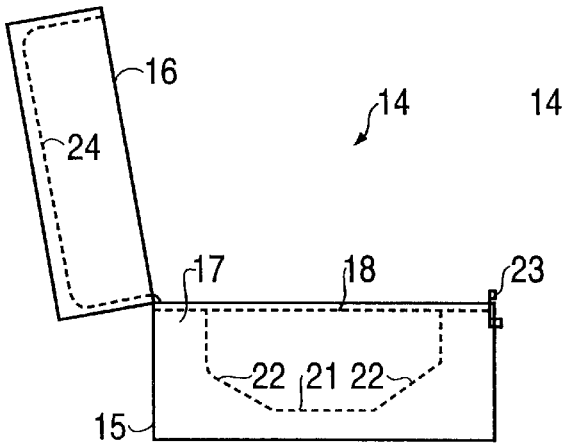
FIG. 4*a*–4*c* shows three schematical, partly sectioned orthogonal views of the device of the invention without the first and the second module.
Figure 4B:
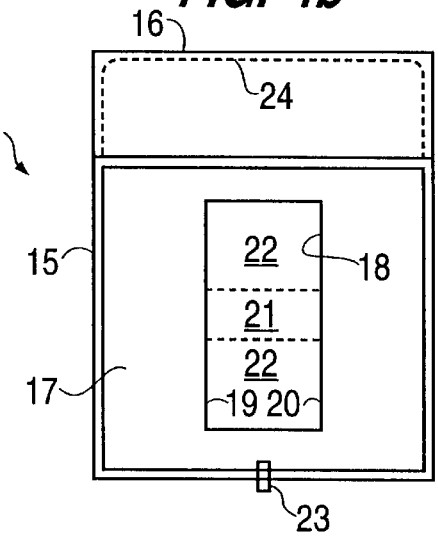
Figure 4C:
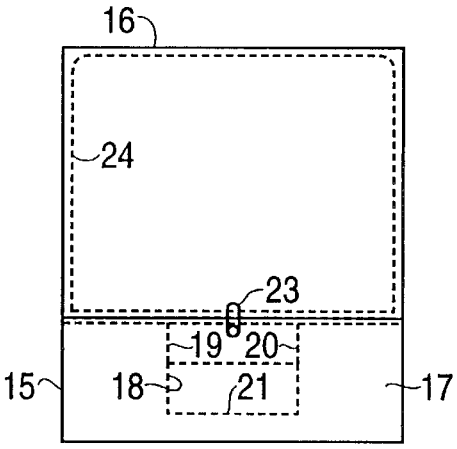

FIG. 4 shows three schematical, partly sectioned orthogonal views of the device according to the invention without first and second module 1, 7, FIGS. 4*a* and 4*c* showing a first and a second side elevation of the device, respectively, and FIG. 4*b* representing a plan view. The device includes a box 14 which is composed of a portion 15 in the form of a receptacle and of a lid 16. Box 14 is provided with a bearing or receiving member cooperating with the support which is either composed of the first module 1 alone or of the two modules 1, 7. According to the example, said member consists of a preformed part 17 having a recess 18 which serves to receive the support in one or the other of its two configurations.

Recess 18 may have an essentially cylindrical form and a cross-section in the shape of a circular or oval segment. In the illustrated example, recess 18 has an essentially prismatic form and a polygonal and convex cross-section. This allows to insert the support along with the presented piece in box 14 at different angles (see FIG. 5), every inclination of the support corresponding to a different oblique presentation position of the concerned piece.

Recess 18 has two parallel side walls 19, 20 in order to clamp the support as well as a base surface 21 having at least one oblique portion 22. Preferentially, the width of first module 1 is slightly greater than the width of second module 7, so that member 17 cooperates with first module 1 essentially. In this manner, the support itself is easily removed from the seat in all its configurations without disconnecting first and second modules 1, 7; otherwise, the removal or extraction of second module 7 alone from seat 17 would be awkward if the two modules were separated. A closure 23 is provided for box 14, as well as a soft layer 24 with a coating on the inside of lid 16, said layer ensuring a safe storage of the packaged and/or presented piece(s) in box 14.

Figure 5:
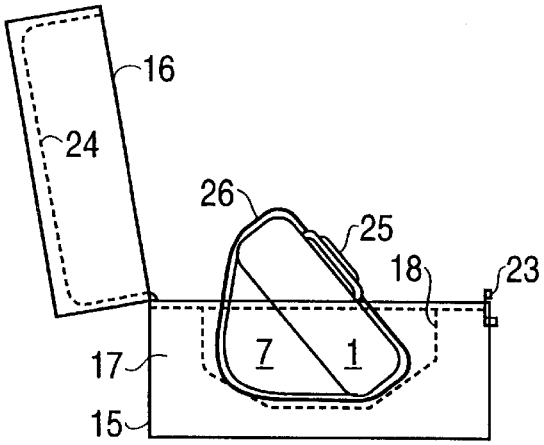
FIG. 5 is a side elevation of the device including the first and the second module in the assembled state.

FIG. 5 is a side elevation of the device with first and second modules 1, 7 in the assembled state. A watch 25, e.g. a watch for men with bracelet 26, is disposed on the support with is formed of the first and the second modules 1, 7. If second module 7 is removed, the support is immediately ready to receive a piece of a different size, e.g. a ladies' watch.

Thus, according to the dimensions of first and second modules 1, 7 (and of possible additional modules), the device of the invention allows an advantageous packaging and presentation of almost all types of pieces of jewelry or of watches.

I claim:

1. A packaging and presentation device for at least one piece of jewelry or a watch, said device comprising a box with an inner recess and comprising a support for attaching said jewelry or said watch thereon, wherein said support is a separate member being independent of said box and being insertable into said inner recess, wherein said support forms a cylinder with closed surface, with two parallel sides, and with a supporting surface of a fixed length, wherein said support is bipartite comprising a first module and a second module, wherein said first module has a first cross-section and bears said supporting surface, wherein said first cross-section is one of an oval cross-section and an oblong cross-section, wherein said second module is fixed to said first module in such a way that the total cross-section of said support is approximately triangular with rounded corners, and that the whole circumference of said support is adapted to the circumference of said piece of jewelry or said watch to be packed or presented.

2. The device of claim 1, wherein said first and said second modules are provided with means allowing to removably interconnect them.

3. The device of claim 2, wherein said first module comprises at least one slot which is adapted to receive a corresponding tongue of said second module.

4. The device of claim 3, wherein the first module comprises two parallel lateral slots which are adapted to receive two corresponding lateral tongues of the second module.

5. The device of claim 3, wherein each said corresponding tongue of the second module has a tongue shape, wherein the tongue shape is one of a triangular shape and a trapezoid shape.

6. The device of claim 1, wherein said box is provided with a receiving or bearing member which is capable of cooperating with said support.

7. The device of claim 6, wherein said receiving or bearing member consists of a preformed part having said inner recess, wherein said inner recess serves to receive the support in any one of its configurations, wherein said recess has a cylindrical form and a cross-section which is one of a circular shape and an oval shape.

8. The device of claim 6, wherein said receiving or bearing member consists of a preformed part having said inner recess, wherein said inner recess serves to receive the support in any one of its configurations, wherein said recess has two parallel sidewalls and a polygonal and connect cross-sectional. two parallel sidewalls and a polygonal and convex cross-section.

9. The device of claim 6, wherein said receiving or bearing member consists of a preformed part having said inner recess, wherein said inner recess serves to receive the support in any one of its configurations, wherein said recess has two parallel side walls in order to clamp the support, as well as a base surface having at least one oblique portion.

10. The device of claim 6, wherein the width of the first module is slightly greater than the width of the second module, in such a manner that said receiving or bearing member cooperates with the first module.

11. The device of claim 1, wherein a plurality of second modules are provided, each of which results in a supporting surface of a different supporting length in the assembled state.

12. A presentation or storage support for at least one piece of jewelry or a watch wherein said support forms a cylinder with closed surface, with two parallel sides, and with a supporting surface of a fixed length, wherein said support is bipartite comprising a first module and a second module, wherein said first module has a first cross-section and bears said supporting surface, wherein said first cross-section is one of an oval cross-section and an oblong cross-section, wherein said second module is fixed to said first module in such a way that the total cross-section of said support is approximately triangular with rounded corners, and that the whole circumference of said support is adapted to the circumference of said piece of jewelry or said watch, wherein said support is capable of being used in a box for packaging or presenting the jewelry or watch, wherein said support is insertable into an inner recess of said box.

* * * * *